United States Patent [19]

Barrett

[11] Patent Number: 4,977,628

[45] Date of Patent: Dec. 18, 1990

[54] WATER CLOSET ARM ASSEMBLY

[76] Inventor: John P. Barrett, 879 Harbor Island, Clearwater, Fla. 33518

[21] Appl. No.: 395,269

[22] Filed: Aug. 17, 1989

[51] Int. Cl.[5] ..... A47K 13/02

[52] U.S. Cl. ..... 4/237; 4/254

[58] Field of Search ..... 4/237, 254, DIG. 8

[56] References Cited

U.S. PATENT DOCUMENTS

| | | | |
|---|---|---|---|
| 2,358,265 | 9/1944 | Thomas | 4/254 |
| 3,405,411 | 10/1968 | Brown | 4/254 |
| 3,574,242 | 4/1971 | Trowbridge | 4/254 |
| 3,594,831 | 7/1971 | Brewer | 4/237 |
| 3,921,236 | 11/1975 | Klein | 4/254 |

FOREIGN PATENT DOCUMENTS

| | | | |
|---|---|---|---|
| 2596265 | 10/1987 | France | 4/254 |

*Primary Examiner*—Henry J. Recla
*Assistant Examiner*—Robert M. Fetsuga
*Attorney, Agent, or Firm*—Frijouf, Rust & Pyle

[57] ABSTRACT

An apparatus is disclosed for an improved water closet arm assembly for a water closet having a water closet seat. One embodiment of the apparatus comprises a substantially flat base member having a first and a second end with the substantially flat base member being mounted to a bottom surface of the water closet seat. A first and a second arm are secure to the first and second ends of the substantially flat base member for assisting a user in lowering and raising the user relative to the water closet seat. In another embodiment of the invention, the arm assembly is integrally incorporated into the water closet seat for securing to a conventional water closet.

5 Claims, 5 Drawing Sheets

WATER CLOSET ARM ASSEMBLY

BACKGROUND OF THE INVENTION

1. Field of the Invention

This invention relates to safety devices and more particularly to a device for assisting a handicapped or an elderly person in using a toilet facility.

2. Prior Art Statement

Various types of handicap and safety devices have been proposed in the prior art for assisting in the daily functions of handicapped or elderly people. An important application of these handicap and safety devices relates to the use of bathroom facilities and more particularly to the use of a toilet facility. Handicap and safety devices related to the use of a toilet facility is important for several reasons. First, bathroom facilities are frequently used and are generally private in nature. Second, a large percentage of accidents in the home occur in the bathroom during the use of the bathroom facilities. Third, few bathrooms have telephones or other means for calling for assistance. Accordingly, an efficient, safe and inexpensive handicap and safety device for assisting a handicapped or an elderly person during the use of the bathroom facilities has been a desired goal sought by the prior art.

The prior art has proposed many solutions for assisting a handicapped or an elderly person in the use of toilet facilities. U.S. Pat. No. 3,474,471 to Matibag discloses arm rests for water closets or the like having retractable arms which are affixed to the toilet seat pivot and are affixed to the floor adjacent the water closet. U.S. Pat. No. 3,574,242 to Trowbridge et al. sets forth an arm assembly for a water closet seat which is connected to the seat pivots as well as being connected to the water closet seat. In a similar manner, U.S. Pat. No. 3,921,236 to Klein discloses a toilet support being pivoted at the toilet seat pivot and fastened at the other end to the seat by having a portion of the seat extending into an opening in the arm of the toilet support. U.S. Pat. No. 3,969,778 to Richards sets forth a toilet aid wherein arm rests are attached to the normal pivot of a water closet seat with members extending outwardly therefrom for resting on the peripheral rim of the water closet. U.S. Pat. No. 4,012,797 to Kristoffersen sets forth a sitting and/or squatting water closet having assisting handles disposed outwardly therefrom. U.S. Pat. No. 4,196,480 to Guenther et al. sets forth a toilet support wherein one or more arms are mounted on bracket supports adjacent the seat of the toilet bowl and being adapted for movement into and out of an operative position. U.S. Pat. No. 4,343,052 to Guenther illustrates first and second arms mounted for pivotal movement about the normal hinge of the water closet seat and wherein the first and second arms can be locked in various axial position relative to one another. U.S. Pat. No. 4,510,631 to Grady discloses a portable commode incorporating hand assisting means. U.S. Pat. No. 4,631,759 to Strasser sets forth a base having removable side rails for elevating a toilet and for incorporating removable side rails. U.S. Pat. No. 4,685,157 to James sets forth a water closet having two side support structures which rest on the ground and are affixed to the pivotal axis of the water closet seat. A subsequent patent to James, namely U.S. Pat. No. 4,715,069, sets forth a modification of the prior James patent wherein the side support structures may be rotatable about the hinge pivot. Although the aforementioned patents have contributed to the progress of the handicap and safety device art, none of these handicap and safety devices have provided a safe, simple and easy to install water closet arm assembly which meets the needs of handicapped and elderly people.

Therefore, it is an object of this invention to provide an improved water closet arm assembly which overcomes the problem encountered by the prior art handicap and safety devices and provides significant advancements in safety and ease of use for handicap and safety devices for water closets.

Another object of this invention is to provide an improved water closet arm assembly which is low cost and is available to handicapped and elderly people on fixed incomes.

Another object of this invention is to provide an improved water closet arm assembly wherein the arm assembly does not interfere with the movement of the water closet seat or the water closet cover.

Another object of this invention is to provide an improved water closet arm assembly wherein the arm assembly may be mounted on a conventional toilet without modification thereof.

Another object of this invention is to provide an improved water closet arm assembly for a water closet which may be mounted on a conventional toilet without modification thereof or may be integrally incorporated in a new water closet seat.

Another object of this invention is to provide an improved water closet arm and water closet seat assembly which is incorporated into a one piece assembly molded of a plastic material.

Another object of this invention is to provide a water closet arm assembly which does not interfere with the normal toilet functions of a user.

Another object of this invention is to provide an improved water closet arm assembly wherein the arm assembly does not interfere with the normal raising of the water closet seat from the water closet.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the first embodiment of the invention relates to an improved water closet arm assembly for a water closet having a water closet seat. The apparatus comprises a substantially flat base member having a first and a second end. The substantially flat base member is mounted to a bottom surface of the water closet seat. A first and a second arm are secure to the first and second ends of the substantially flat base member for assisting a user in lowering and raising the user relative to the water closet seat.

In a more specific embodiment of the invention, the water closet has a water closet seat and a water closet tank. The substantially flat base member is arcuate in shape for mounting to a front portion of the water closet seat. The mounting means may include a plurality of apertures for receiving mechanical fasteners for mounting the substantially flat base member to the bottom surface of the water closet seat. In the alternative, the mounting means may include adhesive means for mounting the substantially flat base member to the bottom surface of the water closet seat. The substantially flat base member may also include resilient means for resiliently spacing the base member from a rim of the water closet.

In one embodiment of the invention, the first and second arms are integrally affixed to the base member. Each of the first and second arms is generally tubular and has a substantially flat terminating hand gripping portion. Each of the first and second arms extends laterally outwardly from the seat of the water closet for enabling the first and second arms to extend outside of a water closet tank when the seat of the water closet is moved into an elevated position. In addition, each of the first and second arms extends upwardly from the seat of the water closet for positioning the first and second arms for assisting a user in lowering and raising the user relative to the water closet seat. Furthermore, each of the first and second arms extends upwardly from the seat of the water closet a distance commensurate with a thickness of a water closet tank for enabling the seat of the water closet to be moved into an elevated position. Finally, each of the first and second arms extends forwardly from the seat of the water closet and extends upwardly from the seat of the water closet for positioning the hand gripping portions of the first and second arms for assisting a user in lowering and raising the user relative to the water closet seat.

In another embodiment of the invention, the arm assembly is integrally incorporated into the water closet seat. The assembly comprises a water closet seat having seat pivot means for engaging with the water closet pivot means to secure the water closet seat to the water closet. A base member has a first and a second end for supporting the first and second arms. Mounting means affix the base member to the water closet seat enabling a user to replace a conventional water closet seat with the improved water closet seat and arm assembly to assist a user in lowering and raising the user relative to the water closet seat. The base member may be affixed internal of the water closet seat and may be integrally molded with the water closet seat. Preferably, the base member includes a substantially flat base member being arcuate in shape for mounting within the water closet seat and for adding mechanical strength.

Still another embodiment of the invention comprises an improved water closet seat and arm assembly for a water closet having water closet aperture means. The invention includes a water closet seat having seat pivot means for engaging with the water closet aperture means to secure the water closet seat to the water closet. A first and a second arm are integrally formed with water closet seat for enabling a user to replace a conventional water closet seat with the improved water closet seat and arm assembly to assist a user in lowering and raising the user relative to the water closet seat.

Preferably, the first and second arms extend from the front portion of the water closet seat and extend only within a front one-third portion of the water closet seat.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

DETAILED DISCUSSION

Figure 1:
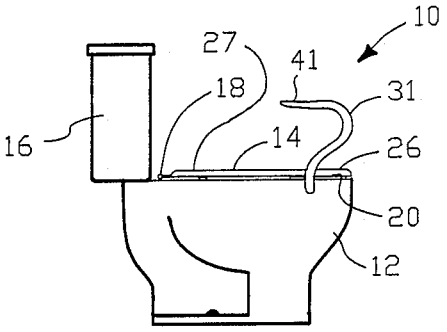
FIG. 1 is a side elevational view of the improved water closet arm assembly secured to a water closet with the water closet seat being located in a lowered position.
Figure 2:
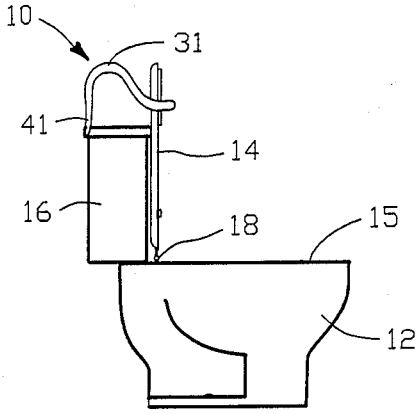
FIG. 2 is a side elevational view of the improved water closet arm assembly secured to the water closet with the water closet seat located in a raised position.
Figure 3:
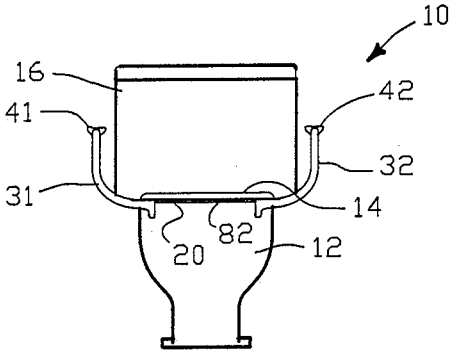
FIG. 3 is a front elevational view of the improved water closet arm assembly secured to a water closet with the water closet seat being located in a lowered position.
Figure 4:
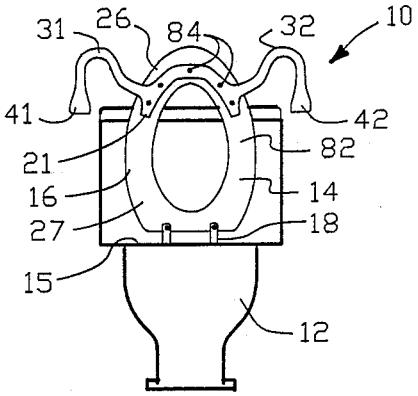
FIG. 4 is a front elevational view of the improved water closet arm assembly secured to the water closet with the water closet seat located in a raised position.
Figure 5:
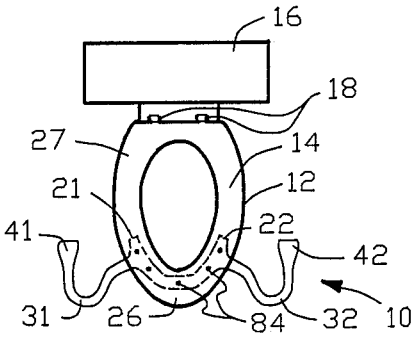
FIG. 5 is a plan view of the improved water closet arm assembly secured to a water closet with the water closet seat being located in a lowered position.
Figure 6:
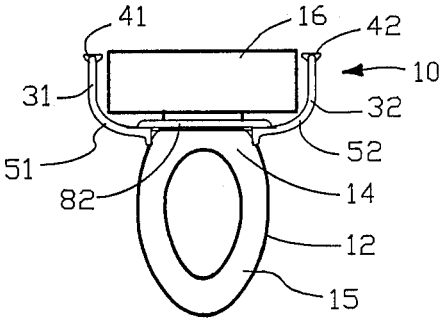
FIG. 6 is a plan view of the improved water closet arm assembly secured to the water closet with the water closet seat located in a raised position.
Figure 7:
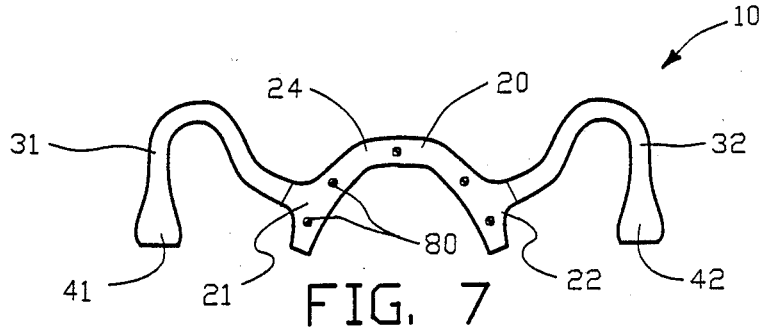
FIG. 7 is a bottom view of the improved water closet arm assembly.
Figure 8:
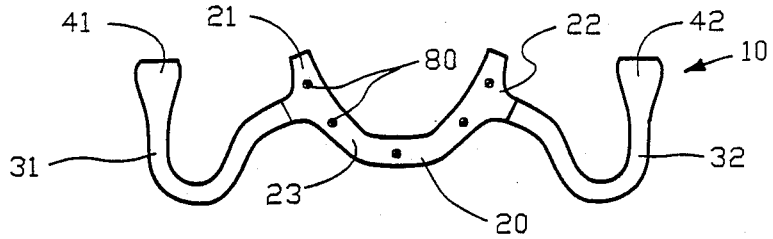
FIG. 8 is a plan view of the improved water closet arm assembly.

FIG. 1 is a side elevational view of the improved water closet arm assembly 10 secured to a conventional water closet 12 with a water closet seat 14 being shown in the lowered position. FIG. 2 is a side elevational view similar to FIG. 1 with the water closet seat 14 being disposed in the raised position. In a similar, manner, FIGS. 3 and 4 illustrate front elevational views of the improved water closet arm assembly 10 with the water closet seat 14 being in the lowered and raised position respectively. Whereas FIGS. 5 and 6 illustrate plan views of the improved water closet arm assembly 10 with the water closet seat 14 being shown in the lowered and raised position respectively.

The water closet 12 is shown as a conventional water closet which is bolted to a floor for supporting a water closet rim 15 and a water tank 16 for retaining flushing water. The water closet seat 14 is secured to the water closet 12 by a pivot 18 which pivot is secured to the water closet 12 through plural bolts (not shown) extending through apertures within the water closet 12 as should be well-known to those skilled in the art. A cover (not shown) may be secured simultaneously to pivot 18 as should as be well-known to those skilled in the art but, for the sake of clarity, the cover has not been shown.

The water closet arm assembly 10 as more fully shown in FIGS. 7–11 comprises a substantially flat base member 20 having a first and a second end 21 and 22 and a top surface 23 and a bottom surface 24. Preferably, the base member 20 is arcuate in shape for following the contour of the water closet seat 14 as shown in FIG. 5. In this embodiment, the arcuate shape of the base member 20 approximates a front portion 26 of the water closet seat 14 leaving a back portion 27 of the water closet seat 14 unencumbered. However, it should be understood that the flat base member 20 may be extended to follow a greater portion of the contour of the water closet seat 14, should greater stability be required by the arm assembly 10.

A first and a second arm 31 and 32 are secured to the first and second ends 21 and 22 of the base member 20. Preferably, the first and second arms 31 and 32 are integrally fixed to the base member 20 by means such as welding or, in the alternative, the first and second arms 31 and 32 may be molded or formed with the base member 20 in a one-piece unit. Each of the first and second arms 31 and 32 is generally tubular and terminates in generally flat hand-gripping portions 41 and 42.

Figure 9:
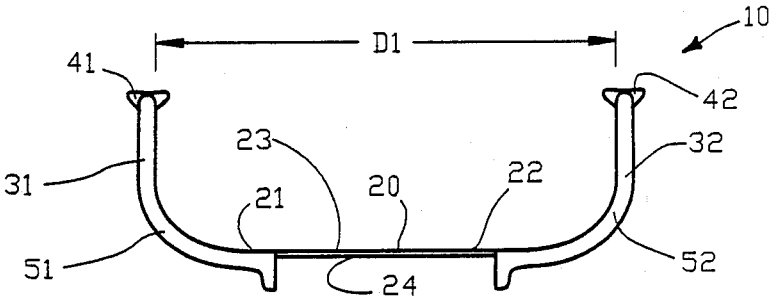
FIG. 9 is a front elevational view of the improved water closet arm assembly.
Figure 10:
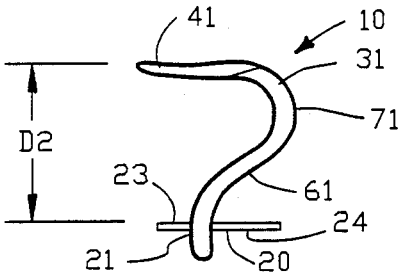
FIG. 10 is a left side elevational view of the improved water closet arm assembly of FIG. 9.
Figure 11:
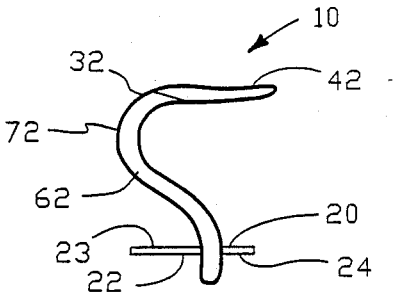
FIG. 11 is a right side elevational view of the improved water closet arm assembly of FIG. 9.

As it can be clearly seen from FIGS. 7–11, each of the first and second arms 31 and 32 extend in a compound curve for providing the desired function of the water closet arm assembly 10. More specifically, the first and second arms 31 and 32 extend laterally outwardly by first bends 51 and 52 for separating the hand-gripping portions 41 and 42 by a distance D1 as shown in FIG. 9 for enabling the first and second arms 31 and 32 to extend outside of the water closet tank 16 when the water closet seat 14 is moved into the raised position as shown in FIG. 6. Furthermore, each of the first and second arms 31 and 32 extend forwardly of the base member 20 as shown by second bends 61 and 62 and extends upwardly as shown in FIGS. 10 and 11 to position the first and second hand-gripping portions 41 and 42 for assisting a user in lowering and raising the user relative to the water closet seat 14. To this end, each of the arms 31 and 32 comprise a third bend 71 and 72 for positioning the hand-gripping portions 41 and 42 in a position for assisting user in lowering and raising the user relative to the water closet seat 14. More specifically, the first and second arms 31 and 32 extend upwardly from the water closet seat 14 a distance D2 as shown in FIG. 10 which is commensurate with the thickness of a conventional water closet tank 16 for enabling the water closet seat 14 to be moved into the raised position as shown in FIG. 2.

The front portion 26 of the water closet seat 14 comprises approximately the front one-third ($\frac{1}{3}$) portion of the water closet seat 14 whereas the back portion 27 of the water closet seat 14 comprises approximately the back two-thirds ($\frac{2}{3}$) portion of the water closet seat 14. As it can be clearly seen from FIGS. 1–11, the first and second arms 31 and 32 do not extend beyond the front one-third ($\frac{1}{3}$) portion 26 of the water closet seat 16 such that the first and second arms 31 and 32 do not interfere with the normal toilet functions of the user. Accordingly, the back portion 27 of the water closet seat 14 is unencumbered and does not inhibit the user during normal toilet functions.

It should also be appreciated that any force applied to the hand-gripping portions 41 and 42 is applied by the first and second arms 31 and 32 to the front portion 26 of the water closet seat 14. A horizontal force applied to the front portion 26 of the water closet seat 14 is transferred through the back two-third ($\frac{2}{3}$) portion 27 of the water closet seat 14 to the water closet 12 through the pivot 18. The base member 20 of the water closet arm assembly 10 shown in FIGS. 1–11 includes a plurality of apertures 80 for mounting the base member 20 to the bottom surface 82 of the water closet seat 14.

Figure 12:
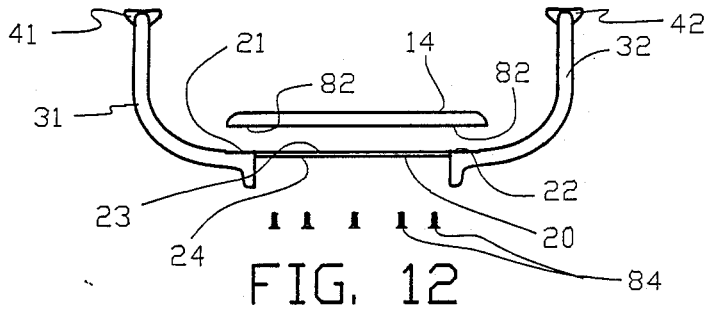
FIG. 12 is an exploded front elevational view illustrating a first means of affixing the improved water closet arm assembly to a toilet seat.

FIG. 12 illustrates an exploded front elevational view of the water closet arm assembly 10 and the water closet seat 14 including a lower surface 82 thereof with a plurality of threaded fasteners shown as screws 84 for affixing the top surface 23 of the base member 20 to the bottom surface 82 of the water closet seat 14. Although the fasteners 84 have been shown as wood screws, it should be appreciated by those skilled in the art that various types of mechanical fasteners may be utilized with the present invention.

Figure 13:
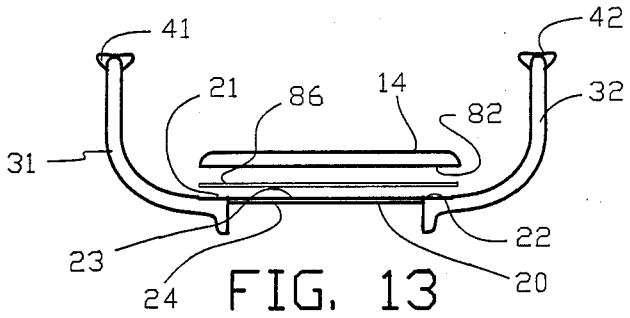
FIG. 13 is an exploded front elevational view illustrating a second means of affixing the improved water closet arm assembly to a toilet seat.

FIG. 13 illustrates an exploded front elevational view of the water closet arm assembly 10 in proximity to the bottom surface 82 of the water closet seat 14 with an adhesive means 86 being interposed between the bottom surface 82 of the water closet seat 14 and the top surface 23 of the base member 20. The adhesive means 86, in this embodiment, secures the base member 20 to the bottom surface 82 of the water closet seat 14. It should be appreciated that the adhesive means 86 may be utilized independently or in addition to the mechanical fasteners 84 shown with reference to FIG. 12.

Figure 14:
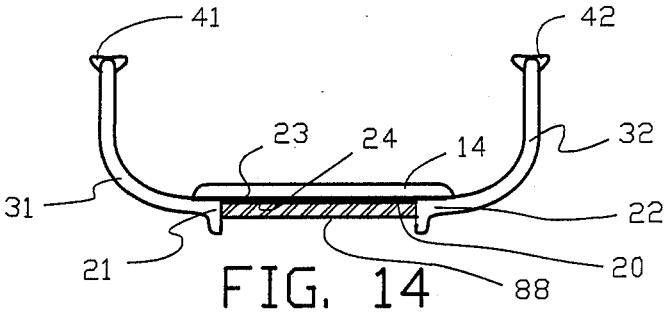
FIG. 14 is a front elevational view illustrating a resilient means affixed to a bottom surface of the improved water closet arm assembly.

FIG. 14 illustrates a front elevational view of the water closet arm assembly 10 secured to the bottom surface 82 of the water closet seat 14 with a resilient means 88 affixed to the bottom surface 24 of the base member 20. The resilient means 88 may be in the form of a natural or synthetic resilient material and may be affixed to the bottom surface 24 of the base member 20 by adhesive means or any other suitable means. The resilient means 88 assists in cushioning the water closet seat 14 against the water closet rim 15. Furthermore, resilient means 88 prevents the base member 20 from scratching the water closet rim 15 of the water closet 14.

Figure 15:
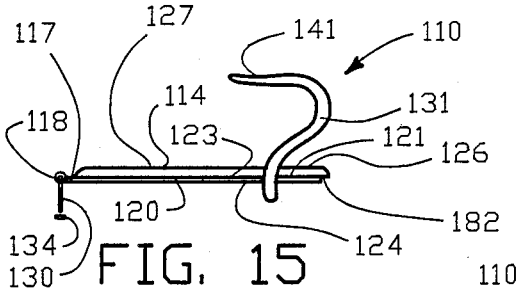
FIG. 15 is a side elevational view of a second embodiment of the improved water closet arm assembly.
Figure 16:
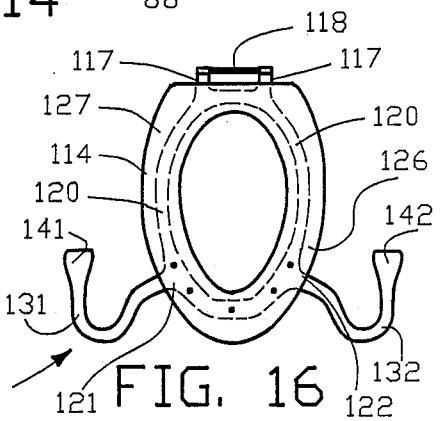
FIG. 16 is a plan view of the second embodiment of the improved water closet arm assembly shown in FIG. 15.

FIGS. 15 and 16 are side and plan views respectively of a second embodiment of a water closet arm assembly 110. The second embodiment of the water closet arm assembly 110 comprises a substantially flat base member 120 having a first and a second end 121 and 122 and a top surface 123 and a bottom surface 124. A first and a second arm 131 and 132 are secured to the first and second ends 121 and 122 of the base member 120 and terminate in generally flat hand-gripping portions 141 and 142. In a manner similar to FIGS. 1–14, each of the first and second arms 131 and 132 extend in a compound curve for providing the desired function of the water closet arm assembly 110.

In this embodiment, the base member 120 is generally oval in shape for following the contour of the entire water closet seat 114. Furthermore, the base member 120 includes a pivot hinge 117 for receiving a pivot 118. Plural pivot bolts 130 similarly receive pivot 118. The pivot bolts 130 are received within plural apertures extending through the water closet (not shown) and are secured thereto by plural nuts 134 as should be well-known to those skilled in the art.

Many prior art water closet seats are secured to the water closet by pivot hinges, pivots, pivot bolts and nuts that are insufficient in mechanical strength to accommodate the forces applied to the hand-gripping portions 141 and 142. Accordingly, the second embodiment of the water closet arm assembly 110 of the present invention shown in FIGS. 15 and 16 replaces the entire support assembly of the water closet seat 114 and replaces the conventional support assembly by the base member 120, the pivot hinge 117, the pivot 118, the pivot bolts 130 and the nuts 134. Accordingly, the second embodiment of the water closet arm assembly 110 provides sufficient mechanical strength to accommodate the forces applied to the hand-gripping portions 141 and 142.

Figure 17:
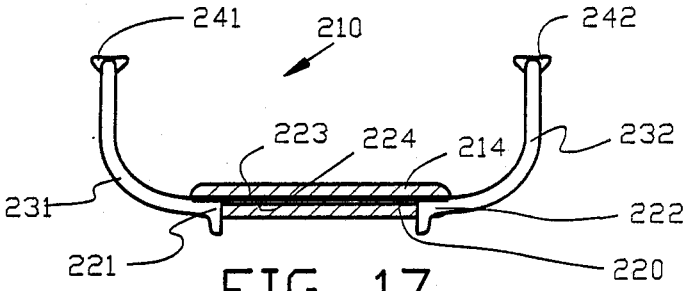
FIG. 17 is an enlarged front elevational view of a third embodiment of the present invention wherein improved water closet arm assembly is integrally formed with the water closet seat.

FIG. 17 illustrates a front sectional view of a third embodiment of the present invention wherein a water closet arm assembly 210 is integrally formed with a water closet seat 214. The third embodiment of the water closet arm assembly 210 comprises a substantially flat base member 220 having a first and a second end 221 and 222 and a top surface 223 and a bottom surface 224. A first and a second arm 231 and 232 are secured to the first and second ends 221 and 222 of the base member 220 and terminate in generally flat hand-gripping portions 241 and 242. In a manner similar to FIGS. 1–16, each of the first and second arms 231 and 232 extend in a compound curve for providing the desired function of the water closet arm assembly 210. In this embodiment, the base member 220 of the water closet assembly 210 is mounted within the water closet seat 214. Both of the top surface 223 and the bottom surface 224 of the base member 220 engage with the material of the water closet seat 214. The water closet seat 214 may be molded or formed of a material such as a polymeric material with the base member disposed within the mold or form. In a molding or forming process, apertures (not shown but which are similar to apertures 80 but enlarged relative thereto) may be defined in the base member 220 for increasing the bonding strength between the base member 220 and the water closet seat 214. In the alternative, projections (not shown) may extend from the base member 220 for increasing the bonding strength between the base member 220 and the water closet seat 214. The base member 220 may either comprise a base member similar to the base member 20 shown in FIGS. 1–14 or the base member 120 shown with reference to FIGS. 15 and 16 or a modification or equivalent thereof.

Figure 18:
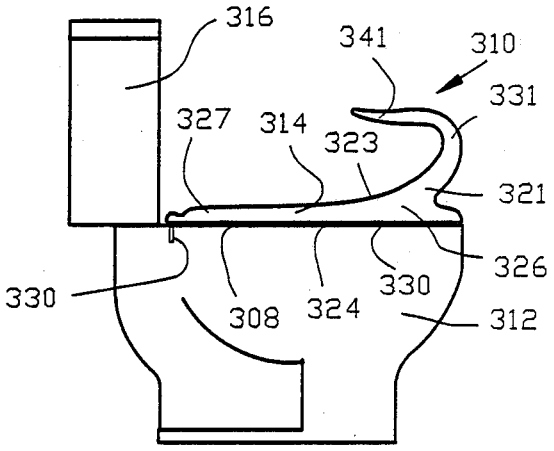
FIG. 18 is a side elevational view of a fourth embodiment of an improved water closet arm and seat assembly secured to a water closet.
Figure 19:
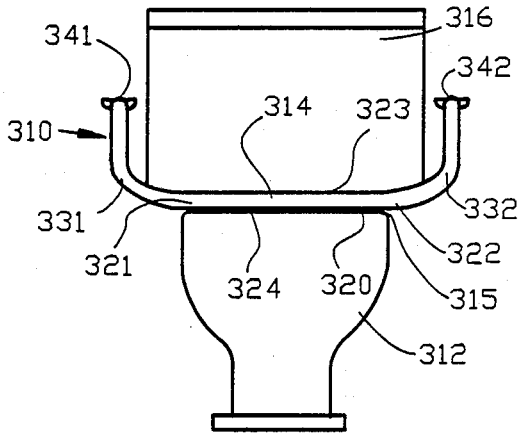
FIG. 19 is a front elevational view of the fourth embodiment of the improved water closet arm and seat assembly of FIG. 18.
Figure 20:
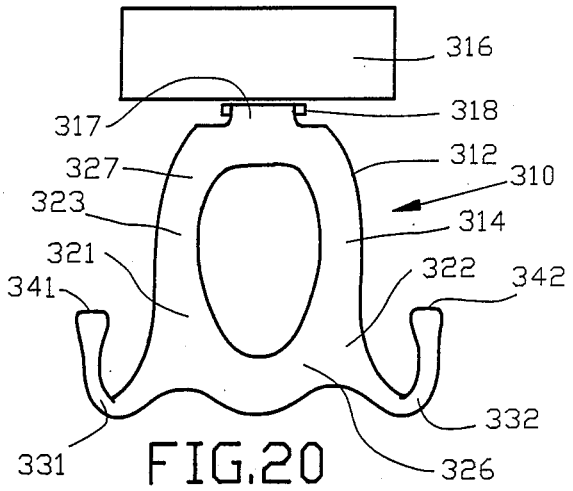
FIG. 20 is a plan view of the fourth embodiment of the improved water closet arm and seat assembly shown in FIG. 19.
Figure 21:
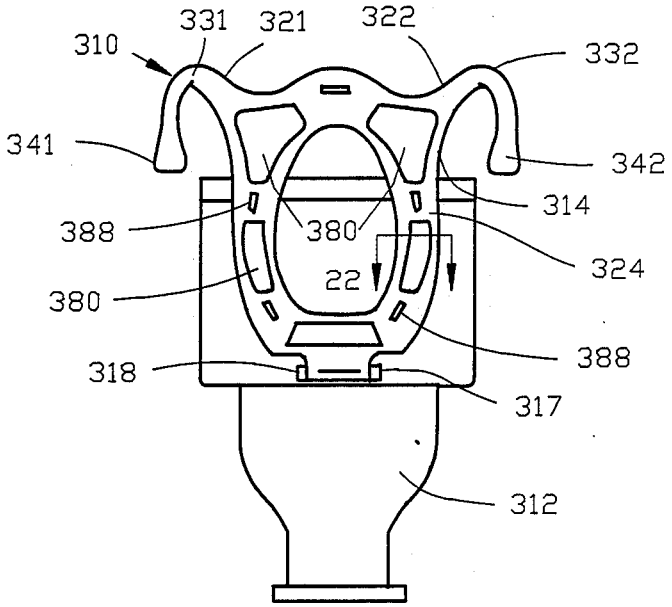
FIG. 21 is a front elevational view of the fourth embodiment of the improved water closet arm and seat assembly of FIG. 19 secured to the water closet with the water closet seat located in a raised position.

FIG. 18 is a side elevational view of a fourth embodiment of an improved water closet arm and seat assembly 310 secured to a conventional water closet 312 with the water closet seat 314 being shown in the lowered position. FIGS. 19 and 20 are a front elevational view and a plan view of the improved water closet arm and seat assembly 310 of FIG. 18. FIG. 21 is a front elevation view of the improved water closet arm and seat assembly 310 of FIG. 19 with the water closet seat 314 being shown in the raised position.

The fourth embodiment of the water closet arm and seat assembly 310 comprises a water closet seat 314 which now defines a base member having a first and a second end 321 and 322 and a top surface 323 and a bottom surface 324. A first and a second arm 331 and 332 are secured to the first and second ends 321 and 322 of the water closet seat 314 and terminate in generally flat hand-gripping portions 341 and 342. In a manner similar to FIGS. 1–16, each of the first and second arms 331 and 332 extend in a compound curve for providing the desired function of the water closet arm and seat assembly 310. The first and a second arm 331 and 332 are integrally secured to the first and second ends 321 and 322 to form a one piece unit.

The water closet seat 314 is generally oval in shape for following the contour of the water closet 312 and includes a front portion 326 and a back portion 327. The water closet arm and seat assembly 310 also comprises a pivot hinge 317 for receiving a pivot 318. Plural pivot bolts 330 are affixed to pivot 318 with the pivot bolts 330 being received within plural apertures (not shown) extending through the water closet 312 and are secured thereto by plural nuts as shown in FIG. 15 as should be well-known to those skilled in the art. In this embodiment, the pivot hinge 317 is integrally formed with the water closet arm and seat assembly 310 to form a one-piece unit.

Figure 22:
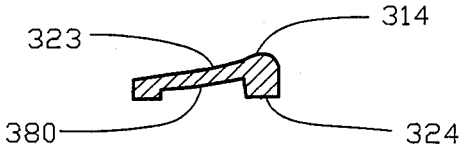
FIG. 22 is a sectional view along line 22—22 in FIG. 21.

The water closet arm and seat assembly 310 may be molded or formed of a material such as a polymeric material. In a molding or forming process, indentation 380 may be defined in the water closet seat 314 as shown in FIG. 22 for reducing the weight and the material required without decreasing the strength of the water closet arm and seat assembly 310. The water closet arm and seat assembly 310 enables a user to replace a conventional water closet seat with the improved water closet seat and arm assembly 310 to assist a user in lowering and raising the user relative to the water closet seat. Resilient means 388 is secured to the bottom surface 324 of the water closet seat 314 for resiliently spacing the water closet seat from a rim 315 of the water closet 312.

The first and second arms 331 and 332 extend from the front portion 326 of the water closet seat 314 laterally outwardly from the water closet seat 314 to extend outside of a water closet tank 316 when the water closet seat 314 is moved into the raised position. In addition, the first and second arms 331 and 332 extends upwardly from the water closet seat 314 for positioning the first and second arms 331 and 332 for assisting a user in lowering and raising the user relative to the water closet seat 314. Furthermore, the first and second arms 331 and 332 extend upwardly a distance commensurate with a thickness of the water closet tank 316 for enabling the water closet seat 314 to be moved into the raised position.

The first and second arms 331 and 332 extend forwardly from the water closet seat 314 and extend upwardly of the water closet seat 314 for positioning the hand gripping portions 341 and 342 of the first and second arms 331 and 332 for assisting a user in lowering and raising the user relative the water closet seat 314. The first and second arms 331 and 332 extend only within a front one-third portion 326 of the water closet seat 314.

Accordingly, the fourth embodiment of the water closet arm and seat assembly 310 of the present invention shown in FIGS. 18–22 replaces the entire support assembly of a conventional water closet seat and replaces the support assembly by the integral arm support and seat assembly 310. Accordingly, the fourth embodiment of the water closet arm and seat assembly 310 provides sufficient mechanical strength to accommodate the forces applies to the hand-gripping portions 341 and 342.

The present invention provides a handicap and safety device which is safe, simple and easy to install on a conventional toilet without modification thereof. The improved water closet arm assembly is low cost and is available to handicapped and elderly people on fixed incomes. Furthermore, the improved water closet arm assembly does not interfere with the movement of the water closet seat or the water closet cover and does not interfere with the normal toilet functions of a user.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved water closet seat and arm assembly for a water closet having water closet aperture means, comprising in combination:

a water closet seat having seat pivot means for engaging with the water closet aperture means to secure said water closet seat to the water closet;

said water closet seat defining a front portion and a back portion with said front portion occupying a front one-third of said water closet seat and with said back portion occupying a back two-third of said water closet seat;

a first and a second arm integrally formed with said water closet seat and extending upwardly from said front portion of said water closet seat and having a first and a second hand gripping means, respectively; and each of said first and second arms extending only within said front portion of said water closet seat for enabling said first and second hand gripping means to assist a user in lowering and raising the user relative to the water closet seat; and said first and second arms enabling the user to perform normal toilet functions adjacent said back portion of said water closet seat while seated thereon without interference from said first and second arms disposed in said front portion of said water closet seat.

2. An improved water closet seat and arm assembly as set forth in claim 1, wherein said water closet seat includes resilient means for resiliently spacing said water closet seat from a rim of the water closet.

3. An improved water closet seat and arm assembly as set forth in claim 1, wherein each of said first and second arms is generally tubular and extends from a first and second base of said water closet seat; and each of said first and second arms terminating in said first and second hand gripping portion.

4. An improved water closet seat and arm assembly for a water closet having water closet aperture means and a water closet tank, comprising in combination:

a water closet seat having seat pivot means for engaging with the water closet aperture means to secure said water closet seat to the water closet;

said water closet seat defining a front portion and a back portion with said front portion occupying a front one-third of said water closet seat and with said back portion occupying a back two-third of said water closet seat;

a first and a second arm integrally formed with said water closet seat and extending from a first and a second base of said front portion of said water closet seat and having a first and a second hand gripping means, respectively;

each of said first and second arms extending laterally outwardly from said first and second base of said water closet seat for enabling said first and second arms to extend outside of a water closet tank when said water closet seat is moved into an elevated position;

each of said first and second arms extending upwardly from said first and second base of said water closet seat a distance commensurate with a thickness of the water closet tank to enable said water closet seat to be moved and retained in said elevated position;

each of said first and second arms extending only within said front portion of said water closet seat for enabling said first and second hand gripping means to assist a user in lowering and raising the user relative to the water closet seat; and said first and second arms enabling the user to perform normal toilet functions adjacent said back portion of said water closet seat while seated thereon without interference from said first and second arms disposed in said front portion of said water closet seat.

5. An improved water closet seat and arm assembly for a water closet having water closet aperture means and a water closet tank, comprising in combination:

a water closet seat having seat pivot means for engaging with the water closet aperture means to secure said water closet seat to the water closet;

said water closet seat defining a front portion and a back portion with said front portion occupying a front one-third of said water closet seat and with said back portion occupying a back two-third of said water closet seat;

a first and a second arm integrally formed with said water closet seat and extending from a first and a second base of said front portion of said water closet seat and having a first and a second hand gripping means, respectively;

each of said first and second arms extending laterally outwardly from said first and second base of said water closet seat by a first bend for separating said first and second hand-gripping portions by a distance sufficient for enabling said first and second arms to extend outside of the water closet tank when said water closet seat is moved into said raised position;

each of said first and second arms extending upwardly in a forward direction from said first and second bases of said water closet seat by a second bend; each of said first and second arms extending upwardly in a backward direction from said second bend by a third bend to position said first and second hand-gripping portions above said first and second bases of said water closet seat a distance commensurate with a thickness of the water closet tank to enable said water closet seat to be moved and retained in said elevated position;

each of said first and second arms extending only within said front portion of said water closet seat for enabling said first and second hand gripping means to assist a user in lowering and raising the user relative to the water closet seat; and said first and second arms enabling the user to perform normal toilet functions adjacent said back portion of said water closet seat while seated thereon without interference from said first and second arms disposed in said front portion of said water closet seat.

* * * * *